US007670657B1

(12) United States Patent
Depoorter et al.

(10) Patent No.: US 7,670,657 B1
(45) Date of Patent: Mar. 2, 2010

(54) PATCH BAG HAVING SEAL THROUGH PATCHES

(75) Inventors: Larry W. Depoorter, Wichita Falls, TX (US); Craig G. Wallington, Marion, IA (US); Edgar A. Chow, Pearland, TX (US); Robert A. Odabashian, Greer, SC (US); Dilip K. Boal, Greenville, SC (US)

(73) Assignee: Cryovac, Inc., Duncan, SC (US)

( * ) Notice: Subject to any disclaimer, the term of this patent is extended or adjusted under 35 U.S.C. 154(b) by 1650 days.

(21) Appl. No.: 09/446,807

(22) PCT Filed: Apr. 3, 1998

(86) PCT No.: PCT/US98/06854

§ 371 (c)(1),
(2), (4) Date: Oct. 2, 2000

(87) PCT Pub. No.: WO98/45187

PCT Pub. Date: Oct. 15, 1998

(51) Int. Cl.
*B32B 1/00* (2006.01)
*B32B 1/08* (2006.01)
*B32B 1/02* (2006.01)

(52) U.S. Cl. ..... 428/34.3; 428/34.1; 428/34.2; 428/35.2; 428/35.7; 428/35.9; 428/36.91

(58) Field of Classification Search ..... 428/34.1, 428/34.2, 35.2, 35.7, 35.9, 36.91
See application file for complete search history.

(56) References Cited

U.S. PATENT DOCUMENTS 3,340,776 A * 9/1967 Shabram ..... 93/8
3,383,746 A 5/1968 Narduzzi et al. ..... 29/33.5
3,552,090 A 1/1971 Roberts et al. ..... 53/71
3,616,004 A * 10/1971 Samson ..... 156/182
3,628,576 A 12/1971 Owen ..... 141/65

(Continued)

FOREIGN PATENT DOCUMENTS

EP 0 151 489 8/1985

(Continued)

OTHER PUBLICATIONS

Determination of Branching Distributions in Polyethylene and Ethylene Copolymers, Journal of Polymer Science: Polymer Physics Edition, vol. 20, pp. 441-455 (1982), John Wiley & Sons.

(Continued)

*Primary Examiner*—Marc A Patterson
(74) *Attorney, Agent, or Firm*—Rupert B. Hurley, Jr.

(57) ABSTRACT

A patch bag comprises a heat-shrinkable bag comprising tubular bag film, and a heat-shrinkable patch comprising a patch film, the patch being adhered to the bag, the patch bag having a seal which is through both patches as well as through both lay-flat sides of the bag. A process for making the bag includes sealing an inside surface of the film tubing to itself, the sealing being carried out by applying heat to each of the patch outside surfaces, the heat being applied by a first means for heating and a second means for heating, the first and second means for heating being in alignment with one another, with the patches and bag tubing therebetween during sealing.

13 Claims, 7 Drawing Sheets

U.S. PATENT DOCUMENTS

| | | | | | |
|---|---|---|---|---|---|
| 4,064,296 | A | | 12/1977 | Bornstein et al. | 428/35 |
| 4,119,267 | A | | 10/1978 | Kydonieus | 229/53 |
| 4,120,716 | A | | 10/1978 | Bonet | 156/272 |
| 4,136,205 | A | | 1/1979 | Quattlebaum | 426/412 |
| 4,239,111 | A | | 12/1980 | Conant et al. | 206/484 |
| 4,267,960 | A | | 5/1981 | Lind et al. | 229/55 |
| 4,278,738 | A | | 7/1981 | Brax et al. | 428/515 |
| 4,302,565 | A | | 11/1981 | Goeke et al. | 526/88 |
| 4,302,566 | A | | 11/1981 | Karol et al. | 526/125 |
| 4,534,984 | A | | 8/1985 | Kuehne | 426/412 |
| 4,539,236 | A | | 9/1985 | Vilutis | 428/35 |
| 4,561,109 | A | * | 12/1985 | Herrington | 383/65 |
| 4,662,521 | A | | 5/1987 | Moretti | 206/484.2 |
| 4,755,403 | A | | 7/1988 | Ferguson | 428/35 |
| 4,801,486 | A | | 1/1989 | Quacquarella et al. | 428/34.9 |
| 4,879,430 | A | | 11/1989 | Hoffman | 428/35.1 |
| 4,890,936 | A | | 1/1990 | Cooper | 383/109 |
| 5,020,922 | A | | 6/1991 | Schirmer | 383/119 |
| 5,206,075 | A | | 4/1993 | Hodgson, Jr. | 428/216 |
| 5,241,031 | A | | 8/1993 | Mehta | 526/348.1 |
| 5,272,236 | A | | 12/1993 | Lai et al. | 526/348.5 |
| 5,278,272 | A | | 1/1994 | Lai et al. | 526/348.5 |
| 5,302,402 | A | | 4/1994 | Dudenhoeffer et al. | 426/129 |
| 5,376,394 | A | | 12/1994 | Dudenhoeffer et al. | 426/415 |
| 5,545,419 | A | | 8/1996 | Brady et al. | 426/129 |

FOREIGN PATENT DOCUMENTS

| | | | |
|---|---|---|---|
| EP | 0 512 740 | A2 | 11/1992 |
| GB | 2 074 128 | | 10/1981 |
| GB | 2 291 402 | A | 1/1998 |
| NZ | 134899 | | 9/1965 |
| NZ | 152723 | | 1/1971 |
| NZ | 230 362 | | 8/1989 |
| NZ | 236 317 | | 12/1990 |
| NZ | 236 523 | | 12/1990 |
| SE | 925 035 | | 5/1963 |
| WO | 90/03414 | | 4/1990 |
| WO | 93/03093 | | 2/1993 |
| WO | 96/00688 | | 1/1996 |

OTHER PUBLICATIONS

Standard Test Method for Unrestrained Linear Thermal Shrinkabe of Plastic Film and Sheeting, ASTM D-2732, pp. 368-371, Sep. 1989.

* cited by examiner

PATCH BAG HAVING SEAL THROUGH PATCHES

BACKGROUND OF THE INVENTION

Patch bags have for some time been used for the packaging of bone-in meat products. Patch bags typically comprise a bag having one or more patches thereover, the patches providing the bag with additional protection against puncture by a bone in a bone-in meat product packaged in the bag.

Some patch bags have been end-seal bags having a "factory seal" across the bottom of the bag, the seal being through a region of the bag which is not covered by the patch. The factory seal is made through an uncovered region of the bag because of difficulties in obtaining a strong seal through both the patch and the bag. However, this uncovered region adjacent the end-seal is especially subject to being punctured by a bone if the particular bone-in meat cut has bone which contacts this uncovered region. It would be desirable to provide patch coverage down to the bottom seal.

One method of providing patch coverage at the bottom of the bag is to provide a secondary seal which is through the patches and the bag, with a primary seal which is through only the bag, i.e., below the supplemental seal. Preferably the secondary seal is an intermittent seal, so that vacuum can be applied to the region between the primary seal and the supplemental seal.

SUMMARY OF THE INVENTION

It has been discovered that it is difficult to measure the seal strength of an intermittent secondary seal. It would be desirable to provide patch coverage down to the bottom seal of the bag, without having to make a supplemental seal and without having to settle for a seal of inferior strength, i.e., compared with a seal made through only the bag film. It has been discovered that a seal can be made through both the patches and the bag, the seal having a strength which is substantially equivalent to the strength of a seal through the bag alone, or even superior to the strength of a seal through the bag alone. In the past, a through-bag-and-patch seal strength of only about 16 to 20 inches of water was obtained, measured via a Standard Linear Ramped Hot Burst Grease Test, described below. However, using the apparatus and process which Applicants' have discovered, surprisingly a through-bag-and-patch seal strength of from at least about 24 up to at least about 48 inches of water has been achieved, using the same test for seal strength.

As a first aspect, the present invention is directed to an end-seal patch bag comprising a heat-shrinkable bag comprising a tubular bag film, and a heat-shrinkable patch comprising a patch film. The patch is adhered to the bag, and extends across the entire width of a first lay-flat side of the tubular bag film. The patch bag has a seal across a bottom region thereof. The seal is continuous across the entire width of the lay-flat bag film. The seal is through both the patch as well as through both lay-flat sides of the bag. The seal is the only seal across the bag.

As a second aspect, the present invention is directed to a patch bag comprising a heat-shrinkable bag comprising a tubular bag film, and a heat-shrinkable patch comprising a patch film. The patch is adhered to the bag, and the patch bag has a seal which is through both the patch as well as through both lay-flat sides of the bag. The seal has a strength of at least 26 inches of water in a Standard Linear Ramp Hot Burst Grease Test. Preferably, the seal has a strength of at least 28 inches of water in a Standard Linear Ramp Hot Burst Grease Test; more preferably, from about 28 to about 50 inches of water; still more preferably, at least 30 inches of water; yet still more preferably, at least 32 inches of water, even yet still more preferably, at least 34 inches of water; still more preferably, at least 36 inches of water; still more preferably, at least 38 inches of water; still more preferably, at least 40 inches of water; and even still more preferably, at least 42 inches of water.

Preferably, the patch bag comprises a first patch adhered to a first lay-flat side of the bag, and a second patch adhered to a second lay-flat side of the bag, with the seal being through both patches and both lay-flat sides of the bag film.

In one alternative, the patch bag is a side-seal patch bag, with both the first patch and the second patch extending along an entire length of the bag, the patch bag having a first seal along a first edge of the bag and a second seal along a second edge of the bag, and a seamless folded bottom edge. The first and second seals are through the first patch, the second patch, and both sides of the lay-flat bag film.

In another alternative, the patch bag is an end-seal patch bag, with both the first patch and the second patch extending across an entire lay-flat width of the bag film in a lay-flat position. The end-seal patch bag has a bottom seal across the bag, the seal being through the first patch, the bag, and the second patch.

In an end-seal patch bag, preferably an upper region of the tubular bag film is not covered by a patch.

Preferably, the patch is adhered to the tubular bag film with an adhesive.

Preferably, the patch is adhered to an outside surface of the tubular bag film, and the entirety of the patch film is adhered to the tubular bag film.

Preferably, each of the patches is wider than the lay-flat width of the tubular bag film.

Preferably, the tubular bag film is a seamless tubing.

Preferably, the seal is made through films having a total thickness of from about 5 to 30 mils; more preferably, from about 10 to 20 mils; still more preferably, from about 12 to 16 mils.

Preferably, the seal has a width of from about 0.015 inch to about 0.25 inch; more preferably, from about 0.03 inch to about 0.16 inch; still more preferably, from about 0.06 inch to about 0.125 inch; yet still more preferably, about 0.09 inch.

As a third aspect, the present invention is directed to a process for making a patch bag, comprising: (A) adhering a first patch film to an outside surface of a first lay-flat side of a lay-flat bag film tubing, the first patch having a width greater than the width of the lay-flat tubing; (B) adhering a second patch to an outside surface of a second lay-flat side of a lay-flat bag film tubing, the second patch also having a width greater than the width of the lay-flat tubing; (C) sealing an inside surface of the film tubing to itself, the sealing being carried out by applying heat to each of the patch outside surfaces, the heat being applied by a first means for heating and a second means for heating, the first and second means for heating being in alignment with one another, with the patches and bag tubing therebetween during sealing; and (D) cutting across the tubing.

Preferably, the first means for heating comprises a first seal bar (wire) which has a flat surface which is in alignment with, and oriented towards, the second means for sealing, which comprises a second seal bar (wire).

In one alternative, the second seal bar has a convex surface (i.e., a crowned surface) which is in alignment with, and oriented towards, the flat surface of the first seal bar.

In another alternative, the second seal bar has a flat surface which is in alignment with, and oriented towards, the flat surface of the first seal bar.

In one embodiment, preferably a seal bar comprises annealed nickel chromium 80.

Preferably, the first seal bar is in a first seal jaw assembly, and the second seal bar is in a second seal jaw assembly, and at least one of the seal jaw assemblies comprises a means for shock absorption. Preferably, the means for shock absorption comprises a resilient member, which preferably comprises an elastomer, more preferably, rubber.

Preferably, while conducting sealing, the temperature (measured via thermocouple, with a 3 mil fluorocarbon-based tape between the thermocouple and the seal bar) of the first and second seal bars is controlled so that they reach an average maximum temperature of from about 180° F. to 400° F. adjacent the region in which the seal bar contacts the film being sealed. Preferably, the means for controlling the temperature constantly monitors and controls the voltage and current flowing through the first and second sealing bars, so as to constantly monitor and control the temperature of the first and second sealing bars at a pre-set maximum temperature during sealing.

During sealing, preferably the seal bars each exert a pressure (on the films) of from about 50 to 150 psi; more preferably, from about 75 to 125 psi; still more preferably, about 100 psi.

DETAILED DESCRIPTION OF THE INVENTION

Figure 1:
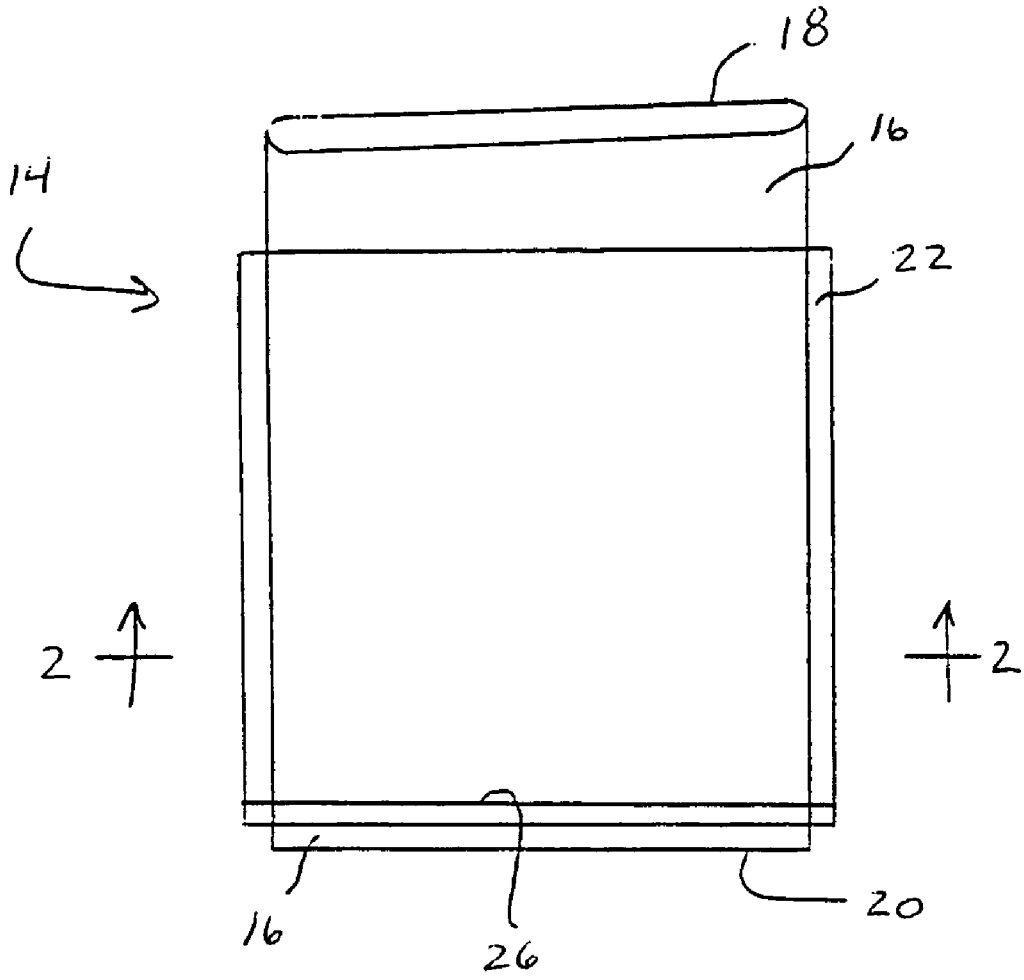
FIG. 1 illustrates a schematic of a preferred end-seal patch bag according to the present invention, in lay-flat view.

As used herein the phrase "uncovered portion of the bag" refers to a portion of the bag which is not covered by a patch, i.e., a portion of the bag having both its inside surface and its outside surface not adhered to, or otherwise covered by, one or more patches.

As used herein, the term "film" is used in a generic sense to include plastic web, regardless of whether it is film or sheet. Preferably, films of and used in the present invention have a thickness of 0.25 mm or less. As used herein, the term "package" refers to packaging materials used in the packaging of a product.

As used herein, the phrase "patch overhang region," or "overhang," refers to that portion of a patch which extends beyond: (a) a side edge of the bag to which the patch is adhered, or (b) a bottom edge of the bag to which the patch is adhered, when the bag is in a lay-flat configuration, i.e., when the factory seal(s) is flat against a surface on which the bag has been placed.

The "factory seal" includes any and all seals necessary to convert a film tubing or flat film into a bag having an open top. Such seals are made at the bag-making factory, and hence are herein termed to be "factory seals".

The bag "edge", or "sideline", or "bottomline", beyond which a patch may overhang, is usually formed by a mere "fold" in the bag. Although the bag need not have a crease at its edges, in reality the side edges of end-seal bags are creased by processing rollers in the manufacture of the tubing and bags, as is the bottom edge of side-seal bags. However, the edge, sideline, or bottomline also includes bag side and bottom edges which are relatively small regions (i.e., 0.05 inches to either side of the "line") extending from a seal through both the patch and the underlying bag. Bag edges, sidelines, and bottomlines are determined by placing an empty bag on a flat supporting surface, with the factory seals flat against the supporting surface. The perimeter of the bag in its lay-flat configuration determines the edges, sidelines, and bottomline.

As used herein, the phrases "seal layer", "sealing layer", "heat seal layer", and "sealant layer", refer to an outer film layer, or layers, involved in the sealing of the film to itself, another film layer of the same or another film, and/or another article which is not a film. With respect to packages having only fin-type seals, as opposed to lap-type seals, the phrase "sealant layer" generally refers to the inside film layer of a package, as well as supporting layers adjacent this sealant layer, the inside layer frequently also serving as a food contact layer in the packaging of foods. In general, a sealant layer to be sealed by heat-sealing can comprise any thermoplastic polymer, preferably, the heat-sealing layer comprises, for example, thermoplastic polyolefin, thermoplastic polyamide, thermoplastic polyester, and thermoplastic polyvinyl chloride; more preferably, thermoplastic polyolefin; still more preferably, thermoplastic polyolefin having less than 60 weight percent crystallinity. Preferred sealant compositions are the same as the compositions for the abuse layer, as set forth below.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, ultrasonic sealing, etc.

As used herein, the phrase "Standard Linear Ramp Hot Burst Grease Test" refers to a test in which a clean sealed bag has peanut oil applied to the seal area (brushed onto the seal on the inside of the bag only), after which the bag is inflated to a specified dwell pressure (12 inches of water) and the seal area is immersed in hot water at 182° F. Five seconds after immersion the pressure inside the bag is increased at the rate of 2 inches of water/second. The time to failure and burst pressure is a measure of seal strength. Test results are reported in seconds and inches of water pressure (IOWP).

As used herein, the term "barrier", and the phrase "barrier layer", as applied to films and/or film layers, is used with reference to the ability of a film or film layer to serve as a barrier to one or more gases. Oxygen (i.e., $O_2$) barrier layers can comprise, for example, ethylene/vinyl alcohol copolymer, polyvinyl chloride, polyvinylidene chloride, polyamide, polyester, polyacrylonitrile, etc., as known to those of skill in the art; preferably, the oxygen barrier layer comprises ethylene/vinyl alcohol copolymer, polyvinyl chloride, polyvinylidene chloride, and polyamide; more preferably, vinylidene chloride/methyl acrylate copolymer, as known to those of skill in the art.

As used herein, the phrase "abuse layer", as well as the phrase "puncture-resistant layer", refer to an outer film layer and/or an inner film layer, so long as the film layer serves to resist abrasion, puncture, and other potential causes of reduction of package integrity, as well as potential causes of reduction of package appearance quality. Abuse layers can comprise any polymer, so long as the polymer contributes to achieving an integrity goal and/or an appearance goal; preferably, abuse layers comprise polymer comprising at least one member selected from the group consisting of ethylene/alpha-olefin copolymer having a density of from about 0.85 to 0.95, propylene/ethylene copolymer, polyamide, ethylene/vinyl acetate copolymer, ethylene/methyl acrylate copolymer, and ethylene/butyl acrylate copolymer, etc. as known to those of skill in the art; more preferably, ethylene/vinyl acetate copolymer and ethylene/alpha-olefin copolymer having a density of from about 0.91 to 0.93; still more preferably, the abuse layer of the bag film comprises 85-100 weight percent ethylene/vinyl acetate copolymer, and 0-15 weight percent LLDPE, while the still more preferred abuse layer of the patch film comprises 85-100 weight percent LLDPE and 0-15 weight percent ethylene/vinyl acetate copolymer having a vinyl acetate content of about 9 percent.

As used herein, the term "core", and the phrase "core layer", as applied to multilayer films, refer to any internal film layer which has a primary function other than serving as an adhesive or compatibilizer for adhering two layers to one another. Usually, the core layer or layers provide the multilayer film with a desired level of strength, i.e., modulus, and/or optics, and/or added abuse-resistance, and/or specific impermeability.

As used herein, the phrase "tie layer" refers to any internal layer having the primary purpose of adhering two layers to one another. Tie layers can comprise any polymer having a polar group grafted thereon, so that the polymer is capable of covalent bonding to polar polymers such as polyamide and ethylene/vinyl alcohol copolymer; preferably, tie layers comprise at least one member selected from the group consisting of polyolefin, modified polyolefin, ethylene/vinyl acetate copolymer, modified ethylene/vinyl acetate copolymer, and homogeneous ethylene/alpha-olefin copolymer; more preferably, tie layers comprise at least one member selected from the group consisting of anhydride modified grafted linear low density polyethylene, anhydride-grafted low density polyethylene, homogeneous ethylene/alpha-olefin copolymer, and anhydride-grafted ethylene/vinyl acetate copolymer.

As used herein, the phrase "bulk layer" refers to any layer of a film which is present for the purpose of increasing the abuse-resistance, toughness, modulus, etc., of a multilayer film. Bulk layers generally comprise polymers which are inexpensive relative to other polymers in the film which provide some specific purpose unrelated to abuse-resistance, modulus, etc. Preferably, bulk layers comprise polyolefin; more preferably, at least one member selected from the group consisting of ethylene/alpha-olefin copolymer, ethylene/alpha-olefin copolymer plastomer, low density polyethylene, and linear low density polyethylene.

As used herein, the phrases "food-contact layer" and "meat-contact layer", refer to a layer of a multilayer film which is in direct contact with the food/meat in the package comprising the film. The food-contact/meat-contact layer is an outer layer of the multilayer film, in the sense that the food-contact/meat-contact layer is in direct contact with the meat product within the package. The food-contact/meat-contact layer is an inside layer in the sense that with respect to the packaged food product/meat product, the food-contact/meat-contact layer is the inside layer (i.e., innermost layer) of the package, this inside layer being in direct contact with the food/meat.

As used herein, the phrases "food-contact surface" and "meat-contact surface" refer to an outer surface of a food-contact layer/meat-contact layer, this outer surface being in direct contact with the food/meat within the package.

As used herein, "EVOH" refers to ethylene/vinyl alcohol copolymer. EVOH includes saponified or hydrolyzed ethylene/vinyl acetate copolymers, and refers to a vinyl alcohol copolymer having an ethylene comonomer, and prepared by, for example, hydrolysis of vinyl acetate copolymers, or by chemical reactions with polyvinyl alcohol. The degree of hydrolysis is preferably at least 50% and more preferably at least 85%.

As used herein, the term "lamination", the term "laminate", and the phrase "laminated film", refer to the process, and resulting product, made by bonding together two or more layers of film or other materials. Lamination can be accomplished by joining layers with adhesives, joining with heat and pressure, and even spread coating and extrusion-coating. The term laminate is also inclusive of coextruded multilayer films comprising one or more tie layers.

As used herein, the term "oriented" refers to a polymer-containing material which has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, refers to oriented films, wherein the orientation can be produced in one or more of a variety of manners.

As used herein, the phrase "orientation ratio" refers to the multiplication product of the extent to which the plastic film material is expanded in several directions, usually two directions perpendicular to one another. Expansion in the machine direction is herein referred to as "drawing", whereas expansion in the transverse direction is herein referred to as "stretching". For films extruded through an annular die, stretching is obtained by "blowing" the film to produce a bubble. For such films, drawing is obtained by passing the film through two sets of powered nip rolls, with the downstream set having a higher surface speed than the upstream set, with the resulting draw ratio being the surface speed of the downstream set of nip rolls divided by the surface speed of the upstream set of nip rolls. The degree of orientation is also referred to as the orientation ratio, or sometimes as the "racking ratio".

As used herein, the term "homopolymer" is used with reference to a polymer resulting from the polymerization of a single monomer, i.e., a polymer consisting essentially of a single type of repeating unit.

As used herein, the term "copolymer" refers to polymers formed by the polymerization reaction of at least two different monomers. For example, the term "copolymer" includes the copolymerization reaction product of ethylene and an alpha-olefin, such as 1-hexene. However, the term "copolymer" is also inclusive of, for example, the copolymerization of a mixture of ethylene, propylene, 1-hexene, and 1-octene.

As used herein, a copolymer identified in terms of a plurality of monomers, e.g., "propylene/ethylene copolymer", refers to a copolymer in which either monomer may copolymerize in a higher weight or molar percent than the other monomer or monomers. However, the first listed monomer preferably polymerizes in a higher weight percent than the second listed monomer, and, for copolymers which are terpolymers, quadripolymers, etc., preferably the first monomer copolymerizes in a higher weight percent than the second monomer, and the second monomer copolymerizes in a higher weight percent than the third monomer, etc.

As used herein, copolymers are identified, i.e., named, in terms of the monomers from which the copolymers are produced. For example, the phrase "propylene/ethylene copolymer" refers to a copolymer produced by the copolymerization of both propylene and ethylene, with or without additional comonomer(s). A copolymer comprises recurring "polymerization units" derived from the monomers from which the copolymer is produced.

As used herein, terminology employing a "/" with respect to the chemical identity of a copolymer (e.g., "an ethylene/alpha-olefin copolymer"), identifies the comonomers which are copolymerized to produce the copolymer. As used herein, "ethylene alpha-olefin copolymer" is the equivalent of "ethylene/alpha-olefin copolymer."

As used herein, the phrase "heterogeneous polymer" refers to polymerization reaction products of relatively wide variation in molecular weight and relatively wide variation in composition distribution, i.e., typical polymers prepared, for example, using conventional Ziegler-Natta catalysts. Heterogeneous polymers are useful in various layers of the film used in the present invention. Although there are a few exceptions (such as TAFMER□ ethylene/alpha-olefin copolymers produced by Mitsui Petrochemical Corporation), heterogeneous polymers typically contain a relatively wide variety of chain lengths and comonomer percentages.

As used herein, the phrase "heterogeneous catalyst" refers to a catalyst suitable for use in the polymerization of heterogeneous polymers, as described above. Heterogeneous catalysts are comprised of several kinds of active sites which differ in Lewis acidity and steric environment. Ziegler-Natta catalysts are heterogeneous catalysts. Examples of Ziegler-Natta heterogeneous systems include metal halides activated by an organometallic co-catalyst, such as titanium chloride, optionally containing magnesium chloride, complexed to trialkyl aluminum, as is disclosed in patents such as U.S. Pat. No. 4,302,565, to GOEKE, et. al., and U.S. Pat. No. 4,302,566, to KAROL, et. al., both of which are hereby incorporated, in their entireties, by reference thereto.

As used herein, the phrase "homogeneous polymer" refers to polymerization reaction products of relatively narrow molecular weight distribution and relatively narrow composition distribution. Homogeneous polymers are useful in various layers of the multilayer film used in the present invention. Homogeneous polymers are structurally different from heterogeneous polymers, in that homogeneous polymers exhibit a relatively even sequencing of comonomers within a chain, a mirroring of sequence distribution in all chains, and a similarity of length of all chains, i.e., a narrower molecular weight distribution. Furthermore, homogeneous polymers are typically prepared using metallocene, or other single-site type catalysis, rather than using Ziegler Natta catalysts.

More particularly, homogeneous ethylene/alpha-olefin copolymers may be characterized by one or more methods known to those of skill in the art, such as molecular weight distribution ($M_w/M_n$), composition distribution breadth index (CDBI), and narrow melting point range and single melt point behavior. The molecular weight distribution ($M_w/M_n$) also known as polydispersity, may be determined by gel permeation chromatography. The homogeneous ethylene/alpha-olefin copolymers useful in this invention preferably has a molecular weight distribution ($M_w/M_n$) of less than 2.7; more preferably, from about 1.9 to 2.5; still more preferably, from about 1.9 to 2.3. The composition distribution breadth index (CDBI) of such homogeneous ethylene/alpha-olefin copolymers is preferably greater than about 70 percent. The CDBI refers to the weight percent of the copolymer molecules having a comonomer content within 50 percent (i.e., plus or minus 50%) of the median total molar comonomer content. The CDBI of linear polyethylene, which does not contain a comonomer, is defined to be 100%. The Composition Distribution Breadth Index (CDBI) is determined via the technique of Temperature Rising Elution Fractionation (TREF). CDBI determination clearly distinguishes the homogeneous copolymers used in the present invention (narrow composition distribution as assessed by CDBI values generally above 70%) from VLDPEs available commercially which generally have a broad composition distribution as assessed by CDBI values generally less than 55%. The CDBI of a copolymer is readily calculated from data obtained from techniques known in the art, such as, for example, temperature rising elution fractionation as described, for example, in Wild et. al., *J. Poly. Sci. Poly. Phys. Ed.*, Vol. 20, p. 441 (1982). Preferably, the homogeneous ethylene/alpha-olefin copolymers have a CDBI greater than about 70%, i.e., a CDBI of from about 70% to 99%. In general, the homogeneous ethylene/alpha-olefin copolymers in the multilayer films of the present invention also exhibit a relatively narrow melting point range, in comparison with "heterogeneous copolymers", i.e., polymers having a CDBI of less than 55%. Preferably, the homogeneous ethylene/alpha-olefin copolymers exhibit an essentially singular melting point characteristic, with a peak melting point ($T_m$), as determined by Differential Scanning Colorimetry (DSC), of from about 60° C. to 110° C. Preferably, the homogeneous copolymer has a DSC peak $T_m$ of from about 80° C. to 100° C. As used herein, the phrase "essentially single melting point" means that at least about 80%, by weight, of the material corresponds to a single $T_m$ peak at a temperature within the range of from about 60° C. to 110° C., and essentially no substantial fraction of the material has a peak melting point in excess of about 115° C., as determined by DSC analysis. DSC measurements are made on a Perkin Elmer System 7 Thermal Analysis System. Melting information reported are second melting data, i.e., the sample is heated at a programmed rate of 110° C./min. to a temperature below its critical range. The sample is then reheated (2nd melting) at a programmed rate of 10° C./min. The presence of higher melting peaks is detrimental to film properties such as haze, and compromises the chances for meaningful reduction in the seal initiation temperature of the final film.

A homogeneous ethylene/alpha-olefin copolymer can, in general, be prepared by the copolymeization of ethylene and any one or more alpha-olefin. Preferably, the alpha-olefin is a $C_3$-$C_{20}$ alpha-monoolefin, more preferably, a $C_4$-$C_{12}$ alpha-monoolefin, still more preferably, a $C_4$-$C_8$ alpha-monoolefin. Still more preferably, the alpha-olefin comprises at least one member selected from the group consisting of butene-1, hexene-1, and octene-1, i.e., 1-butene, 1-hexene, and 1-octene, respectively. Most preferably, the alpha-olefin comprises octene-1, and/or a blend of hexene-1 and butene-1.

Processes for preparing and using homogeneous polymers are disclosed in U.S. Pat. No. 5,206,075, U.S. Pat. No. 5,241,031, and PCT International Application WO 93/03093, each of which is hereby incorporated by reference thereto, in its entirety. Further details regarding the production and use of homogeneous ethylene/alpha-olefin copolymers are disclosed in PCT International Publication Number WO 90/03414, and PCT International Publication Number WO 93/03093, both of which designate Exxon Chemical Patents, Inc. as the Applicant, and both of which are hereby incorporated by reference thereto, in their respective entireties.

Still another genus of homogeneous ethylene/alpha-olefin copolymers is disclosed in U.S. Pat. No. 5,272,236, to LAI, et. al., and U.S. Pat. No. 5,278,272, to LAI, et. al., both of which are hereby incorporated by reference thereto, in their respective entireties.

As used herein, the term "polyolefin" refers to any polymerized olefin, which can be linear, branched, cyclic, aliphatic, aromatic, substituted, or unsubstituted. More specifically, included in the term polyolefin are homopolymers of olefin, copolymers of olefin, copolymers of an olefin and an non-olefinic comonomer copolymerizable with the olefin, such as vinyl monomers, modified polymers thereof, and the like. Specific examples include polyethylene homopolymer, polypropylene homopolymer, polybutene, ethylene/alpha-olefin copolymer, propylene/alpha-olefin copolymer, butene/alpha-olefin copolymer, ethylene/vinyl acetate copolymer, ethylene/ethyl acrylate copolymer, ethylene/butyl acrylate copolymer, ethylene/methyl acrylate copolymer, ethylene/acrylic acid copolymer, ethylene/methacrylic acid copolymer, modified polyolefin resin, ionomer resin, polymethylpentene, etc. Modified polyolefin resin is inclusive of modified polymer prepared by copolymerizing the homopolymer of the olefin or copolymer thereof with an unsaturated carboxylic acid, e.g., maleic acid, fumaric acid or the like, or a derivative thereof such as the anhydride, ester or metal salt or the like. It could also be obtained by incorporating into the olefin homopolymer or copolymer, an unsaturated carboxylic acid, e.g., maleic acid, fumaric acid or the like, or a derivative thereof such as the anhydride, ester or metal salt or the like.

As used herein, terms identifying polymers, such as "polyamide", "polyester", "polyurethane", etc. are inclusive of not only polymers comprising repeating units derived from monomers known to polymerize to form a polymer of the named type, but are also inclusive of comonomers derivatives, etc. which can copolymerize with monomers known to polymerize to produce the named polymer. For example, the term "polyamide" encompasses both polymers comprising repeating units derived from monomers, such as caprolactam, which polymerize to form a polyamide, as well as copolymers derived from the copolymerization of caprolactam with a comonomer which when polymerized alone does not result in the formation of a polyamide. Furthermore, terms identifying polymers are also inclusive of mixtures, blends, etc. of such polymers with other polymers of a different type.

As used herein, the phrase "modified polymer", as well as more specific phrases such as "modified ethylene/vinyl acetate copolymer", and "modified polyolefin" refer to such polymers having an anhydride functionality, as set forth immediately above, grafted thereon and/or copolymerized therewith and/or blended therewith. Preferably, such modified polymers have the anhydride functionality grafted on or polymerized therewith, as opposed to merely blended therewith.

As used herein, the phrase "anhydride-containing polymer" and "anhydride-modified polymer", refer to one or more of the following: (1) polymers obtained by copolymerizing an anhydride-containing monomer with a second, different monomer, and (2) anhydride-grafted copolymers, and (3) a mixture of a polymer and an anhydride-containing compound.

As used herein, the phrase "ethylene alpha-olefin copolymer", and "ethylene/alpha-olefin copolymer", refer to such heterogeneous materials as linear low density polyethylene (LLDPE), and very low and ultra low density polyethylene (VLDPE and ULDPE); and homogeneous polymers such as metallocene-catalyzed polymers such as EXACT□ resins obtainable from the Exxon Chemical Company, and TAFMER□ resins obtainable from the Mitsui Petrochemical Corporation. All these materials generally include copolymers of ethylene with one or more comonomers selected from $C_4$ to $C_{10}$ alpha-olefin such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. The heterogeneous ethylene/alpha-olefin commonly known as LLDPE has a density usually in the range of from about 0.91 grams per cubic centimeter to about 0.94 grams per cubic centimeter. Other ethylene/alpha-olefin copolymers, such as the long chain branched homogeneous ethylene/alpha-olefin copolymers available from the Dow Chemical Company, known as AFFINITY® resins, are also included as another type of homogeneous ethylene alpha-olefin copolymer useful in the present invention.

In general, the ethylene/alpha-olefin copolymer comprises a copolymer resulting from the copolymerization of from about 80 to 99 weight percent ethylene and from 1 to 20 weight percent alpha-olefin. Preferably, the ethylene/alpha-olefin copolymer comprises a copolymer resulting from the copolymerization of from about 85 to 95 weight percent ethylene and from 5 to 15 weight percent alpha-olefin.

As used herein, the phrases "inner layer" and "internal layer" refer to any layer, of a multilayer film, having both of its principal surfaces directly adhered to another layer of the film.

As used herein, the phrase "outer layer" refers to any film layer of film having less than two of its principal surfaces directly adhered to another layer of the film. The phrase is inclusive of monolayer and multilayer films. In multilayer films, there are two outer layers, each of which has a principal surface adhered to only one other layer of the multilayer film. In monolayer films, there is only one layer, which, of course, is an outer layer in that neither of its two principal surfaces are adhered to another layer of the film.

As used herein, the phrase "inside layer" refers to the outer layer, of a multilayer film packaging a product, which is closest to the product, relative to the other layers of the multilayer film.

As used herein, the phrase "outside layer" refers to the outer layer, of a multilayer film packaging a product, which is furthest from the product relative to the other layers of the multilayer film.

As used herein, the term "adhered" is inclusive of films which are directly adhered to one another using a heat seal or other means, as well as films which are adhered to one another using an adhesive which is between the two films.

As used herein, the phrase "directly adhered", as applied to film layers, refers to the adhesion of the subject film layer to the object film layer, without a tie layer, adhesive, or other layer therebetween. In contrast, as used herein, the word "between", as applied to a film layer expressed as being between two other specified layers, includes both direct adherence of the subject layer to one or more of the two other layers it is between, as well as including a lack of direct adherence to either or both of the two other layers the subject layer is between, i.e., one or more additional layers can be imposed between the subject layer and one or more of the layers the subject layer is between.

As used herein, the phrase "machine direction", herein abbreviated "MD", refers to a direction "along the length" of the film, i.e., in the direction in which the film is formed during extrusion and/or coating.

As used herein, the phrase "transverse direction", herein abbreviated "TD", refers to a direction across the film, perpendicular to the machine or longitudinal direction.

As used herein, the phrase "free shrink" refers to the percent dimensional change in a 10 cm×10 cm specimen of film, when subjected to selected heat, as measured by ASTM D 2732, as known to those of skill in the art.

Although the films used in the patch bag according to the present invention can be monolayer films or multilayer films, the patch bag comprises at least two films laminated together. Preferably, the patch bag is comprised of a patch film and a bag film which together comprise a total of from 2 to 20 layers; more preferably, from 2 to 12 layers; and still more preferably, from 4 to 9 layers.

In general, the multilayer film(s) used in the present invention can have any total thickness desired, so long as the film provides the desired properties for the particular packaging operation in which the film is used, e.g. abuse-resistance (especially puncture-resistance), modulus, seal strength, optics, etc.

Figure 2:
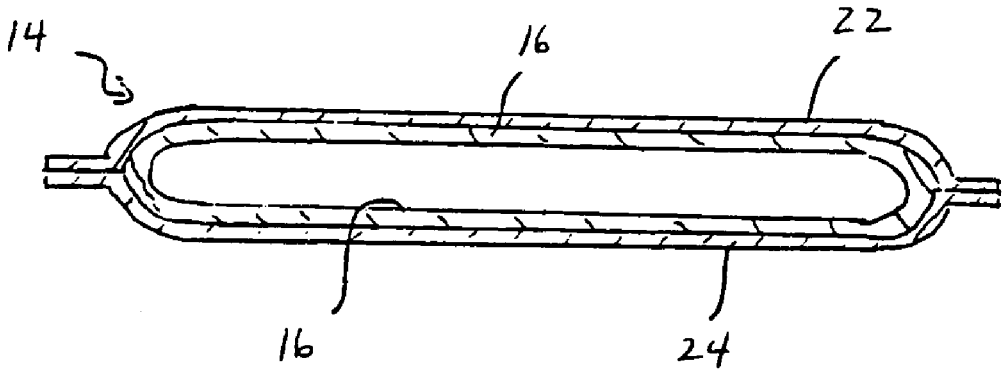
FIG. 2 illustrates a cross-sectional view of the preferred end-seal patch bag according to FIG. 1, taken through section 2-2 of FIG. 1.

FIGS. 1 and 2 illustrate a preferred patch bag 14 according to the present invention. Patch bag 14 has bag 16, top 18, bottom 20, more-than-full-width patches 22 and 24, and bottom seal 26. Importantly, seal 26 is a heat seal which is formed by applying heat through both patches 22 and 24.

Preferably, seal 20 is formed by simultaneously applying heat seal bars against both sides of a tubing to which patches have been adhered. In one preferred embodiment, the heat seal bars are made from an annealed alloy known as "nickel chromium 80." Such seal bars have been obtained from Kanthal Corporation of Bethal, Conn., and are sold as Nicrothal™ 80 seal wires. Preferably, each of these bars has a width of about 0.0965 inch, and a thickness of about 0.0165 inch. Preferably, each of the bars is in a groove in a seal jaw, the groove having a depth of about 0.01 inch. The bag film tubing having patches adhered thereto is run through the heat seal jaws, and the seal is made by bringing the jaws together and applying a current of 36 amps (rms) through each of the bars, the bars exerting a pressure on the film of about 100 psi. Preferably, the tubing with patches adhered thereto is fed horizontally, with the lower seal jaw being stationary, and the upper jaw reciprocating vertically about 1 inch during the sealing cycle. Preferably, the hot seal bars are in contact with the film for a period of from about ¼ second to 1 second; more preferably, about ⅓ second.

In this manner, it has been found that a strong seal can be made, even simultaneously through both the bag film and the patch film. Seal bars having flat film contact surfaces are preferred because they can achieve better alignment with one another than other cross-sectional shapes, such as round seal bar cross-sections, which are more difficult to align with one another, and which have been found to slip out of alignment with one another when forced against each other during sealing. It has also been found to be preferable to provide a means for dampening impact of the sealing bars with the film, in order to prevent damage to the film by the seal bars during sealing, and in order to ensure parallel alignment of the sealing bars during sealing. A preferred dampening means is a resilient member, such as a rubber pad, located between the upper jaw and a stainless C-channel having a grooved section to retain the fluorocarbon-tape-covered seal bar described above. The lower seal jaw also has a grooved member for retaining the lower seal bar in alignment with the upper seal bar, so that both seal bars converge upon one another, with the film therebetween. Both seal bars are covered on both sides by a tape made from TEFLON® fluorocarbon resin. The tape between the seal bar and the film to be sealed is preferably a 3-mil fluorocarbon tape having a thickness of about 3 mils. The tape between the seal bars and the sealing jaws are preferably two 5 mil fluorocarbon tapes. Thus, for each of the seal bars there is 3 mil of fluorocarbon tape on the side of the seal bar which is to come into contact with the film, and 10 mil of fluorocarbon tape on the side of the seal bars away from the film to be sealed, i.e., towards the sealing jaw.

During the sealing process, current is intermittently applied to the sealing bars so that with each seal made, the bars cycle from a low temperature (between seals) to a high temperature (during sealing). For example, during the sealing cycle in the sealing system described above, the sealing bars reach an average temperature (measured over the 3 mil fluorocarbon-based tape, in a portion of the seal bar beside the region which is intermittently contacting the patch bags being sealed) within the range of from about 480 to 530° F. Such a high average temperature has been found to produce fumes to which some individuals (i.e., in close proximity to the seal bars) have objected. It is suspected that the source of the fumes may be the heating of the above-described fluorocarbon tape which covers each of the seal bars. In the sealing process as described above, the flow of 36 amps of current through the bar causes it to quickly reach an elevated temperature of over 400° F. It is believed that in achieving this temperature, the fluorocarbon-based tape covering the seal bar produces the above-described fumes.

It has been discovered that even if the sealing bar continues to remain in contact the fluorocarbon-based tape throughout the sealing, the fumes can be substantially reduced or avoided by controlling the temperature of the sealing bars, i.e., by lowering the average temperature of the sealing bars by providing a means for controlling the sealing temperature. It has been found that by lowering the average temperature of the sealing bar, i.e., from the unregulated average temperature of from about 480° F. to 530° F. to an average temperature of from about 180° F. to about 400° F., the objectionable fumes are substantially reduced or avoided.

A preferred means for controlling the temperature of the sealing bars is available from Toss Machine Components, Inc., of Nazareth, Pa. More specifically, the means includes control unit Toss RES-225-O-3/230V/60 HZ; TEFLON® cover strip (i.e., fluorocarbon based tape) Toss CS08/8-35-12E30, and, for example, 12 inch top seal bar Th2.5x.15x838e235c and 12 inch bag bottom wire RB3.0x.15x838e235c. Different seal bar lengths are used for different seal lengths. The excess portion of the seal bar is preferably copper coated in order to reduce the resistance (and temperature) of that portion of the seal bar which does not come into contact with the film to be sealed. The control unit controls the temperature of the seal bars by monitoring and controlling both the voltage and the current flowing through the seal bars, the control being carried out to result in a constant resistance. In this manner, the average high temperature of the seal bars can be controlled.

In the resulting bag, the seal is thicker than the bag because the patch and bag films are preferably heat-shrinkable, and therefore shrink during and shortly after the sealing process is carried out. As a result, the completed seal is thicker than the remaining film. Moreover, each side of the bag is left with an impression from its respective heat seal bar. [This is in contrast to prior art heat seals which have applied heat through only one side of the bag, thereby leaving an impression from a heat seal bar only on one side of the bag.]

Preferably, the film stock from which the patches are cut has a total thickness of from about 2 to 8 mils; more preferably, from about 3 to 6 mils.

Figure 3:
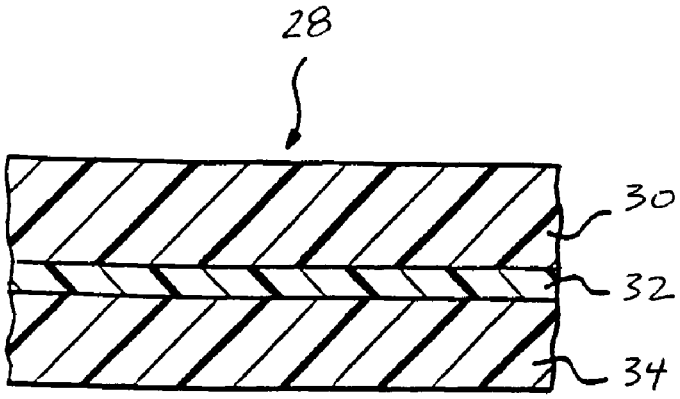
FIG. 3 illustrates a cross-sectional view of preferred multilayer film for use as a patch in the patch bag of the present invention.

FIG. 3 illustrates a cross-sectional view of preferred multilayer film 28 for use as the stock material from which patches 22 and 24 are formed. Multilayer film 28 has a physical structure, in terms of number of layers, layer thickness, and layer arrangement and orientation in the patch bag, and a chemical composition in terms of the various polymers, etc. present in each of the layers, as set forth in Table I, below.

TABLE I

| Layer Designation | Layer Function | Layer Chemical Identity | Layer Thickness (mils) |
|---|---|---|---|
| 30 | outside & puncture-resistant | 87% LLDPE #1; 10% EVA #1; 3% antiblock masterbatch #1 | 2.0 |
| 32 | tie | EVA #2 | 0.7 |
| 34 | inside & puncture-resistant | 87% LLDPE #1; 10% EVA #1; 3% antiblock masterbatch #1 | 2.0 |

LLDPE #1 was DOWLEx® 2045 linear low density polyethylene, obtained from the Dow Chemical Company of Midland, Mich. EVA #1 was ELVAX® 3128 ethylene/vinyl acetate copolymer having a 9% vinyl acetate content, obtained from E.I. DuPont de Nemours, of Wilmington, Del. EVA #2 was ELVAX 3175 GO□ ethylene/vinyl acetate copolymer having a 28% vinyl acetate content, obtained from E.I. DuPont de Nemours, of Wilmington, Del. Antiblock masterbatch #1 was used in either of two different grades. The first grade, a clear masterbatch, was a masterbatch known as 10,075 ACP SYLOID CONCENTRATE□ obtained from Technor Apex Co. of Pawtucket, R.I. The second grade, a creme colored masterbatch, was a masterbatch known as EPC 9621C CREAM COLOR SYLOID CONCENTRATE□, also obtained from Technor Apex Co. of Pawtucket, R.I. The primary difference between these two masterbatches is that of color, which is both aesthetic, and potentially functional in that photosensor alignment means for accurate registration of the patches on the bags can utilize the coloration in the patch for detection of the location of the patch.

Figure 4:
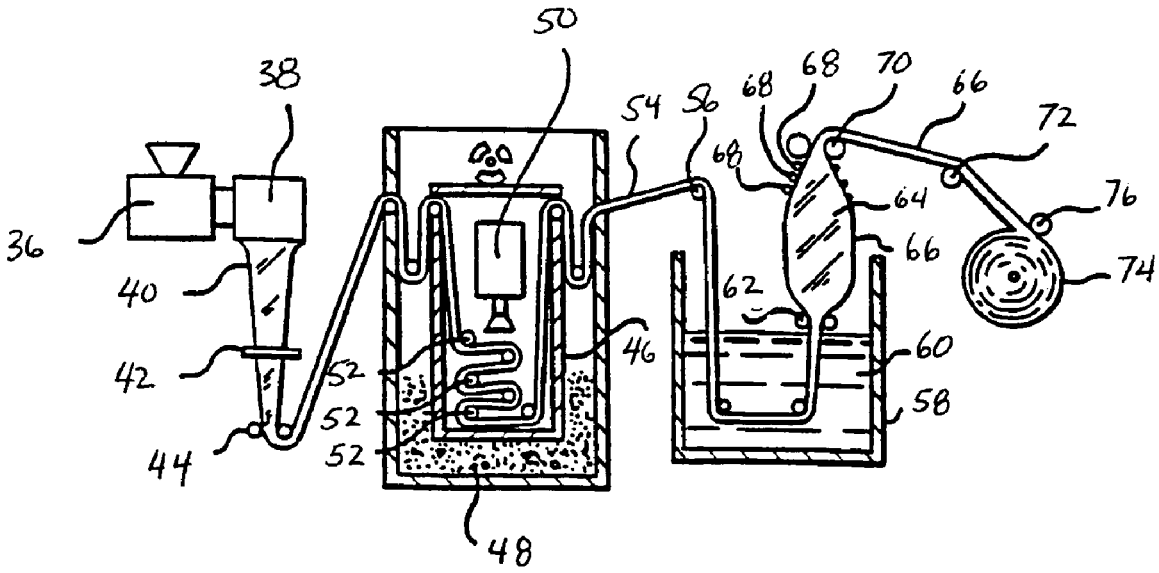
FIG. 4 illustrates a schematic view of a preferred process for producing the multilayer film of FIG. 3.

FIG. 4 illustrates a schematic of a preferred process for producing the multilayer patch film of FIG. 3. Preferably, the patch film is made in accordance with the process described in U.S. Pat. No. 4,755,403, to Ferguson. In the process illustrated in FIG. 4, solid polymer beads (not illustrated) are fed to a plurality of extruders 36 (for simplicity, only one extruder is illustrated). Inside extruders 36, the polymer beads are forwarded, melted, and degassed, following which the resulting bubble-free melt is forwarded into die head 38, and extruded through annular die, resulting in tubing 40 which is 5-40 mils thick, more preferably 20-30 mils thick, still more preferably, about 25 mils thick.

The extruded seamless tubing is cooled and quenched by water spray from cooling ring 42. The interior of the tube is coated with an inert dust or powder, preferably powdered cornstarch, in a surface concentration sufficient to prevent self-adherence prior to orientation (but in an amount which permits self-adherence after orientation). Tubing 40 is collapsed by pinch rolls 44, and is thereafter fed through irradiation vault 46 surrounded by shielding 48, where tubing 40 is irradiated with high energy electrons (i.e., ionizing radiation) from iron core transformer accelerator 50. Tubing 40 is guided through irradiation vault 46 on rolls 52. Preferably, the irradiation of tubing 40 is at a level of about 7 MR.

After irradiation, irradiated tubing 54 is directed over guide roll 56, after which irradiated tubing 54 passes into hot water bath tank 58 containing water 60. The now-collapsed irradiated tubing 54 is submersed in the hot water for a retention time of at least about 5 seconds, i.e., for a time period in order to bring the film up to the desired temperature, following which supplemental heating means (not illustrated) including a plurality of steam rolls around which irradiated tubing 54 is partially wound, and optional hot air blowers, elevate the temperature of irradiated tubing 54 to a desired orientation temperature of from about 240° F.-250° F. Thereafter, irradiated film 54 is directed through nip rolls 62, and bubble 64 is blown, thereby transversely stretching irradiated tubing 54. Furthermore, while being blown, i.e., transversely stretched, irradiated film 54 is drawn (i.e., in the longitudinal direction) between nip rolls 62 and nip rolls 70, as nip rolls 70 have a higher surface speed than the surface speed of nip rolls 62. As a result of the transverse stretching and longitudinal drawing, irradiated, biaxially-oriented, blown tubing film 66 is produced, this blown tubing preferably having been both stretched at a ratio of from about 1:1.5-1:6, and drawn at a ratio of from about 1:1.5-1:6. More preferably, the stretching and drawing are each performed at a ratio of from about 1:2-1:4. The result is a biaxial orientation of from about 1:2.25-1:36, more preferably, 1:4-1:16.

While bubble 64 is maintained between pinch rolls 62 and 70, blown tubing 66 is collapsed by rolls 68, and thereafter conveyed through pinch rolls 70 and across guide roll 72, and then rolled onto wind-up roll 74. Idler roll 76 assures a good wind-up. Blown tubing 66 self-welds to form a heat-shrinkable film of doubled thickness. Preferably, the stock film from the patch is formed has a total thickness of from about 1.5 to 5 mils; more preferably, about 2.5 mils. Preferably the stock film from which the patch is formed is a self-welded multilayer film having from 2 to 8 layers; more preferably, from 3 to 6 layers; still more preferably, from 3 to 4 layers.

Figure 5:
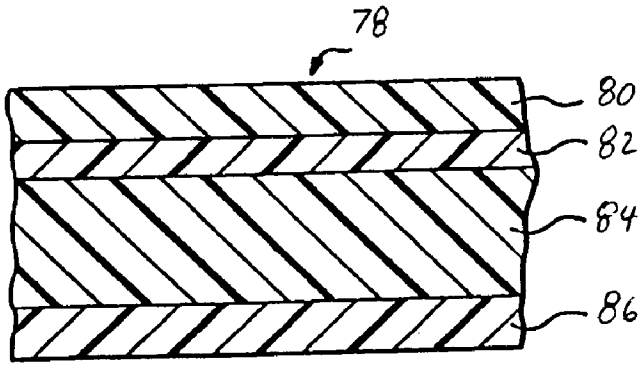
FIG. 5 illustrates a cross-sectional view of preferred multilayer film for use as the bag in the patch bag of the present invention.

FIG. 5 illustrates a cross-sectional view of preferred multilayer film 78 for use as the tubing film stock from which bag 16 is formed. Multilayer film 78 has a physical structure, in terms of number of layers, layer thickness, and layer arrangement and orientation in the patch bag, and a chemical composition in terms of the various polymers, etc. present in each of the layers, as set forth in Table II, below.

TABLE II

| Layer Designation | Layer Function | Layer Chemical Identity | Layer Thickness (mils) |
|---|---|---|---|
| 80 | outside & abuse | 10% EVA #1; | 0.56 |
| 82 | barrier | 96% VDC/MA #1; 2% epoxidized soybean oil; 2% bu-A/MA/bu-MA terpolymer | 0.2 |
| 84 | inside & puncture-resistant | 80% LLDPE #1 20% EBA #1 | 1.25 |
| 86 | sealant and inside | EVA #1 | 0.33 |

EVA #1 was the same ethylene/vinyl acetate copolymer described above. VDC/MA #1 was SARAN MA-134□ vinylidene chloride/methyl acrylate copolymer, obtained from the Dow Chemical Company. The epoxidized soybean oil was PLAS-CHEK□ 775 epoxidized soybean oil, obtained from the Bedford Chemical Division of Ferro Corporation, of Walton Hills, Ohio. Bu-A/MA/bu-MA terpolymer was METABLEN□ L-1000 butyl acrylate/methyl methacrylate/butyl methacrylate terpolymer, obtained from Elf Atochem North America, Inc., of 2000 Market Street, Philadelphia, Pa. 19103. EBA #1 was EA 705-009□ ethylene/butyl acrylate copolymer containing 5% butyl acrylate, obtained from the Quantum Chemical Company of Cincinnati, Ohio. Alternatively, EBA #1 can be EA 719-009□ ethylene/butyl acrylate copolymer, having a butyl acrylate content of 18.5%, also obtained from Quantum Chemical Company.

Figure 6:
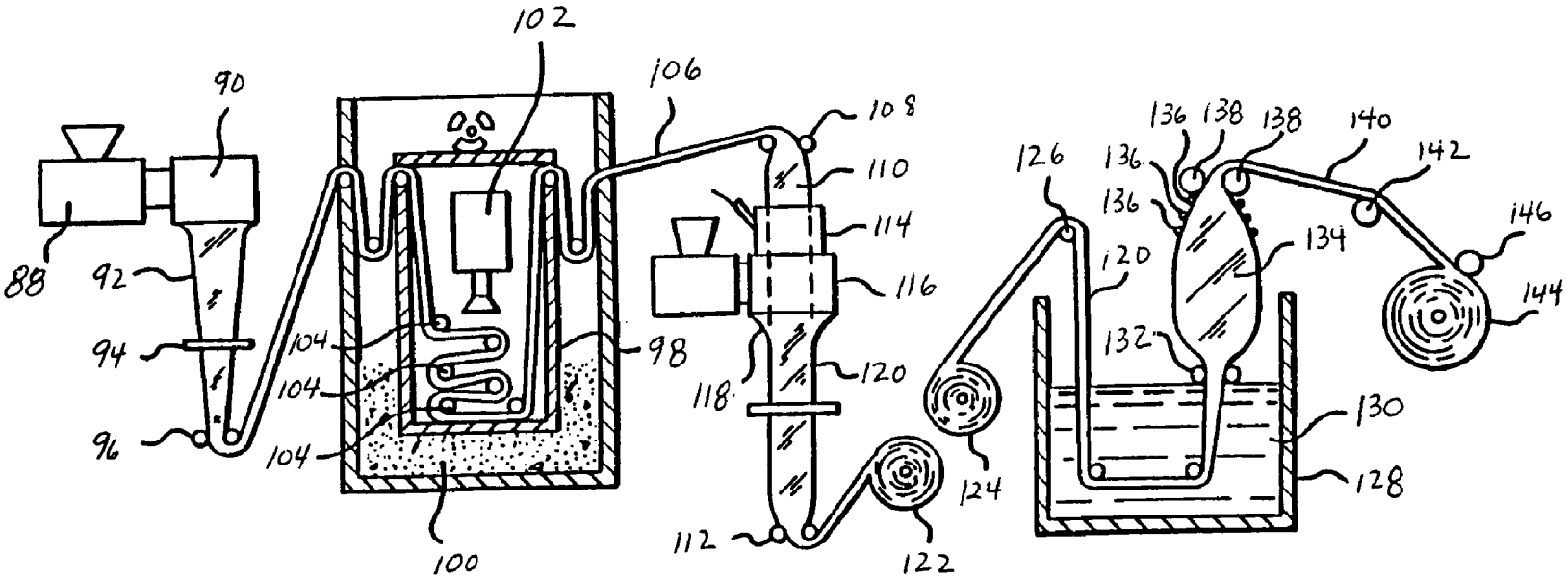
FIG. 6 illustrates a schematic of a preferred process for producing the multilayer film of FIG. 5.

FIG. 6 illustrates a schematic of a preferred process for producing the multilayer film of FIG. 5. In the process illustrated in FIG. 6, solid polymer beads (not illustrated) are fed to a plurality of extruders 88 (for simplicity, only one extruder is illustrated). Inside extruders 88, the polymer beads are forwarded, melted, and degassed, following which the resulting bubble-free melt is forwarded into die head 90, and extruded through an annular die, resulting in tubing 92 which is 10-30 mils thick, more preferably 15-25 mils thick.

After cooling or quenching by water spray from cooling ring 94, tubing 92 is collapsed by pinch rolls 96, and is thereafter fed through irradiation vault 98 surrounded by shielding 100, where tubing 92 is irradiated with high energy electrons (i.e., ionizing radiation) from iron core transformer accelerator 102. Tubing 92 is guided through irradiation vault 98 on rollers 104. Preferably, tubing 92 is irradiated to a level of about 4.5 MR.

After irradiation, irradiated tubing 106 is directed through pinch rolls 108, following which tubing 106 is slightly inflated, resulting in trapped bubble 110. However, at trapped bubble 110, the tubing is not significantly drawn longitudinally, as the surface speed of nip rolls 112 are about the same speed as nip rolls 108. Furthermore, irradiated tubing 106 is inflated only enough to provide a substantially circular tubing without significant transverse orientation, i.e., without stretching.

Slightly inflated, irradiated tubing 106 is passed through vacuum chamber 114, and thereafter forwarded through coating die 116. Second tubular film 118 is melt extruded from coating die 116 and coated onto slightly inflated, irradiated tube 106, to form two-ply tubular film 120. Second tubular film 118 preferably comprises an $O_2$-barrier layer, which does not pass through the ionizing radiation. Further details of the above-described coating step are generally as set forth in U.S. Pat. No. 4,278,738, to BRAX et. al., which is hereby incorporated by reference thereto, in its entirety.

After irradiation and coating, two-ply tubing film 120 is wound up onto windup roll 122. Thereafter, windup roll 122 is removed and installed as unwind roll 124, on a second stage in the process of making the tubing film as ultimately desired. Two-ply tubular film 120, from unwind roll 124, is unwound and passed over guide roll 126, after which two-ply tubular film 120 passes into hot water bath tank 128 containing water 130. The now collapsed, irradiated, coated tubular film 120 is submersed in hot water 130 (having a temperature of about 210° F.) for a retention time of at least about 5 seconds, i.e., for a time period in order to bring the film up to the desired temperature for biaxial orientation. Thereafter, irradiated tubular film 120 is directed through nip rolls 132, and bubble 134 is blown, thereby transversely stretching tubular film 120. Furthermore, while being blown, i.e., transversely stretched, nip rolls 138 draw tubular film 120 in the longitudinal direction, as nip rolls 138 have a surface speed higher than the surface speed of nip rolls 132. As a result of the transverse stretching and longitudinal drawing, irradiated, coated biaxially-oriented blown tubing film 140 is produced, this blown tubing preferably having been both stretched in a ratio of from about 1:1.5-1:6, and drawn in a ratio of from about 1:1.5-1:6. More preferably, the stretching and drawing are each performed a ratio of from about 1:2-1:4. The result is a biaxial orientation of from about 1:2.25-1:36, more preferably, 1:4-1:16. While bubble 134 is maintained between pinch rolls 132 and 138, blown tubing 140 is collapsed by rolls 136, and thereafter conveyed through pinch rolls 138 and across guide roll 142, and then rolled onto wind-up roll 144. Idler roll 146 assures a good wind-up. Preferably, the stock film from which the bag is formed has a total thickness of from about 1.5 to 5 mils; more preferably, about 2.5 mils. Preferably the stock film from which the bag is formed is a multilayer film having from 3 to 7 layers; more preferably, 4 layers.

The polymer components used to fabricate multilayer films according to the present invention may also contain appropriate amounts of other additives normally included in such compositions. These include slip agents such as talc, antioxidants, fillers, dyes, pigments and dyes, radiation stabilizers, antistatic agents, elastomers, and the like additives known to those of skill in the art of packaging films.

The multilayer films used to make the patch bag of the present invention are preferably irradiated to induce crosslinking, as well as corona treated to roughen the surface of the films which are to be adhered to one another. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. al., which is hereby incorporated in its entirety, by reference thereto. BORNSTEIN, et. al. discloses the use of ionizing radiation for crosslinking the polymer present in the film.

To produce crosslinking, a suitable radiation dosage of high energy electrons is in the range of up to about 12 MR, more preferably about 2 to about 9 MR, and still more preferably, about 3 MR. Preferably, irradiation is carried out by an electron accelerator and the dosage level is determined by standard dosimetry methods.

Other accelerators such as a Vander Graff or resonating transformer may be used. The radiation is not limited to electrons from an accelerator since any ionizing radiation may be used. The unit of ionizing radiation generally used is the rad, hereinafter referred to as "RAD", which is defined as the amount of radiation which will result in the absorption of 100 ergs of energy per gram of irradiated material. The megarad, hereinafter referred to as "MR", is one million ($10^6$) RAD. The ionizing radiation crosslinks the polymers in the film. Preferably, the film is irradiated at a level of from 2-15 MR, more preferably 2-10 MR, still more preferably, about 7 MR. As can be seen from the descriptions of preferred films for use in the present invention, the most preferred amount of radiation is dependent upon the film and its end use.

As used herein, the phrases "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness.

Corona treatment of polymeric materials is disclosed in U.S. Pat. No. 4,120,716, to BONET, issued Oct. 17, 1978, herein incorporated in its entirety by reference thereto, discloses improved adherence characteristics of the surface of polyethylene by corona treatment, to oxidize the polyethylene surface. U.S. Pat. No. 4,879,430, to HOFFMAN, also hereby incorporated in its entirety by reference thereto, discloses the use of corona discharge for the treatment of plastic webs for use in meat cook-in packaging, with the corona treatment of the inside surface of the web to increase the adhesion of the meat to the adhesion of the meat to the proteinaceous material.

Although corona treatment is a preferred treatment of the multilayer films used to make the patch bag of the present invention, plasma treatment of the film may also be used.

Patch bags in accordance with the present invention can be made as follows. First, patch film, e.g., as in FIG. 3, can be made by the process illustrated in FIG. 4. Bag film, e.g., as in FIG. 5, can be made by the process illustrated in FIG. 6. Thereafter, the patch and bag films can be further processed in accordance with the process illustrated in FIG. 7, described below.

Figure 7:
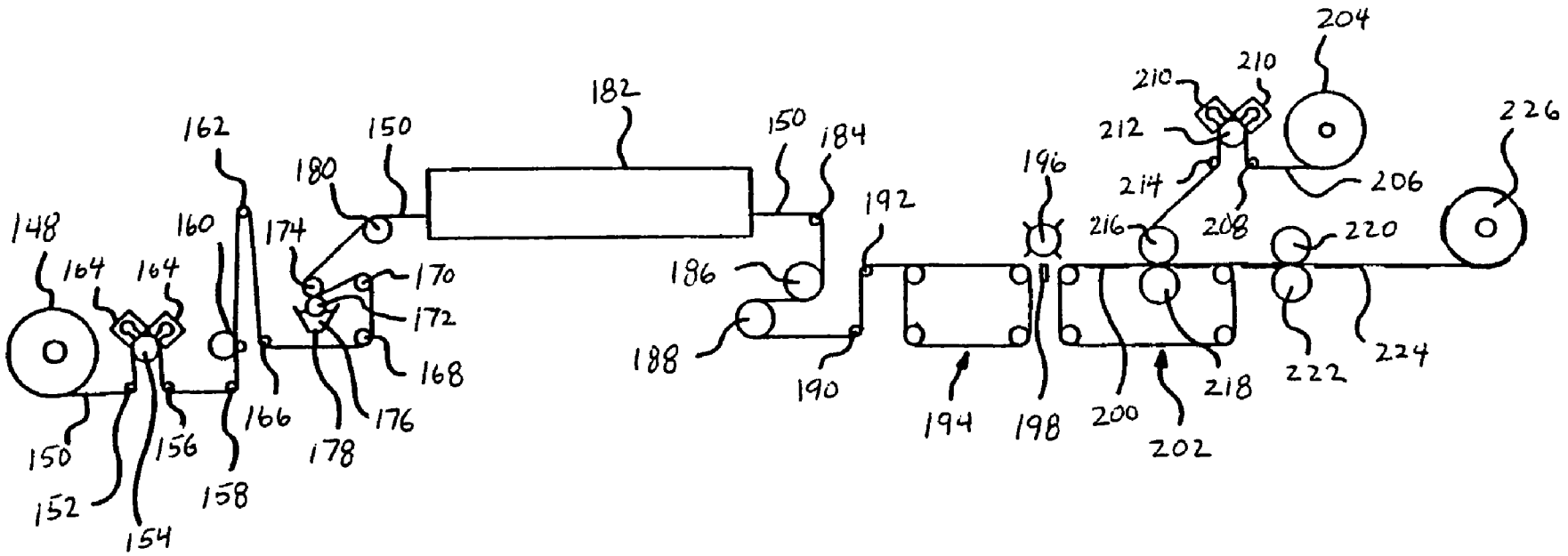
FIG. 7 illustrates a schematic representation of a preferred process for manufacturing a patch bag according to the present invention.

In the bag-making process, if an end-seal patch bag is the desired product, the tubing having the first and second patches adhered thereto is sealed and cut so that an end-seal bag is produced. FIG. 7 illustrates a schematic representation of a preferred process for manufacturing a patch bag according to the present invention (e.g., a patch bag as illustrated in FIGS. 1 and 2) from the films as illustrated in FIGS. 3 and 5, which are prepared according to processes as illustrated in FIGS. 4 and 6, respectively.

In FIG. 7, patch film roll 148 supplies patch film 150. Patch film 150 is directed, by idler roll 152, to corona treatment devices 164 which subject the upper surface of patch film 150 to corona treatment as patch film 150 passes over corona treatment roll 154. After corona treatment, patch film 150 is directed, by idler rolls 1156 and 158, and (optional) printing roll 160.

Patch film 150 is thereafter directed over idler rolls 162, 166, 168, and 170, after which patch film 150 is passed between a small gap (i.e., a gap wide enough to accommodate patch film 150 passing therethrough while receiving an amount of adhesive which corresponds with a dry coating, i.e., weight after drying, of about 45 milligrams per 10 square inches of patch film) between adhesive application roll 172 and adhesive metering roll 174. Adhesive application roll 172 is partially immersed in adhesive 176 supplied to trough 178. As adhesive roll 172 rotates counter-clockwise, adhesive 176, picked up by the immersed surface of adhesive roll 172, moves upward, contacts, and is metered onto, the full width of one side of patch film 150, moving in the same direction as the surface of adhesive roll 172. [Examples of suitable types of adhesives include thermoplastic acrylic emulsions, solvent based adhesives and high solids adhesives, ultraviolet-cured adhesive, and electron-beam cured adhesive, as known to those of skill in the art. The presently preferred adhesive is a thermoplastic acrylic emulsion known as RHOPLEX N619□ thermoplastic acrylic emulsion, obtained from the Rohm & Haas Company, at Dominion Plaza Suite 545, 17304 Preston Rd., Dallas, Tex. 75252, Rohm & Haas having headquarters at 7th floor, Independence Mall West, Philadelphia, Pa. 19105.] Patch film 150 thereafter passes so far around adhesive metering roll 174 (rotating clockwise) that the adhesive-coated side of patch film 150 is in an orientation wherein the adhesive is on the top surface of patch film 150, as adhesive-coated patch film 150 moves between adhesive metering roll 174 and idler roll 180.

Thereafter, adhesive-coated patch film 150 is directed over drying oven entrance idler roll 180, and passed through oven 182 within which patch film 150 is dried to a degree that adhesive 176 on patch film 150 becomes tacky. Upon exiting oven 182, patch film 150 is directed partially around oven-exit idler roll 184, following which patch film 150 is cooled on chill rolls 186 and 188, each of which has a surface temperature of about 40-45° F., and a diameter of about 12 inches. The cooling of patch film 150 is carried out in order to stabilize patch film 150 from further shrinkage.

Thereafter, patch film 150 is directed, by idler rolls 190 and 192, onto a belt of pre-cutting vacuum conveyor assembly 194, and thereafter forwarded to a rotary scissors-type knife having upper rotary blade assembly 196 and lower blade 198, the knife cutting across the width of patch film 150 in order to form patches 200. Patches 200 are forwarded and held on top of a belt of post-cutting vacuum conveyor assembly 202. While patches 200 are held on the belt of post-cutting vacuum conveyor assembly 202, tubing-supply roll 204 supplies biaxially oriented, lay-flat film tubing 206, which is directed, by idler roll 208, to corona treatment devices 210 which subject the upper surface of lay-flat tubing film 206 to corona treatment as lay-flat tubing film 206 passes over corona treatment roll 212. After corona treatment, lay-flat tubing film 206 is directed, by idler roll 214, partially around the surface of upper pre-lamination nip roll 216, and through the nip between upper prelaminating nip roll 216 and lower prelaminating nip roll 218, the pre-laminating nip rolls being above and below the post-cutting vacuum conveyor belt. Prelaminating nip rolls 216 and 218 position patches 200 onto the now lower, corona-treated outside surface of lay-flat film tubing 206. After passing through the nip between prelaminating nip rolls 216 and 218, lay-flat tubing 206, now having patches 200 laminated intermittently thereon, exits off the downstream end of the post-cutting vacuum conveyor assembly 202, and is directed through the nip between upper laminating nip roll 220 and lower laminating nip roll 222, these rolls exerting pressure (about 75 psi) in order to secure patches 200 to lay-flat tubing 206, to result in patch-laminated lay-flat tubing 224. Thereafter, patch-laminated lay-flat tubing 224 is wound up to form rewind roll 226, with rewind roll 226 having the laminated patches thereon oriented towards the outer-facing surface of rewind roll 226.

In a subsequent process not separately illustrated, rewind roll 226 is removed from its winder and is positioned in the place of tubing supply roll 204, and the process of FIG. 7, described immediately above, is repeated, wherein a second set of patches is laminated to patch-laminated lay-flat tubing 226, this second set of patches being applied to the other side of patch-laminated lay-flat tubing 226. Of course, the second set of patches are accurately aligned and registered so that they are substantially aligned with the positioning of the first set of patches laminated to lay-flat tubing film 206. In order to achieve accurate alignment, photosensors (i.e., photoeyes, etc.), not illustrated, are used to detect the location of the patch. An appropriate location for such a photosensor is upstream of upper pre-lamination roll 216, below the patch-laminated lay-flat tubing. Once both sets of patches have been applied to lay-flat tubing film 206, the resulting two-patch tubing is directed into a bag-making machine, in a process not illustrated.

Figure 8:
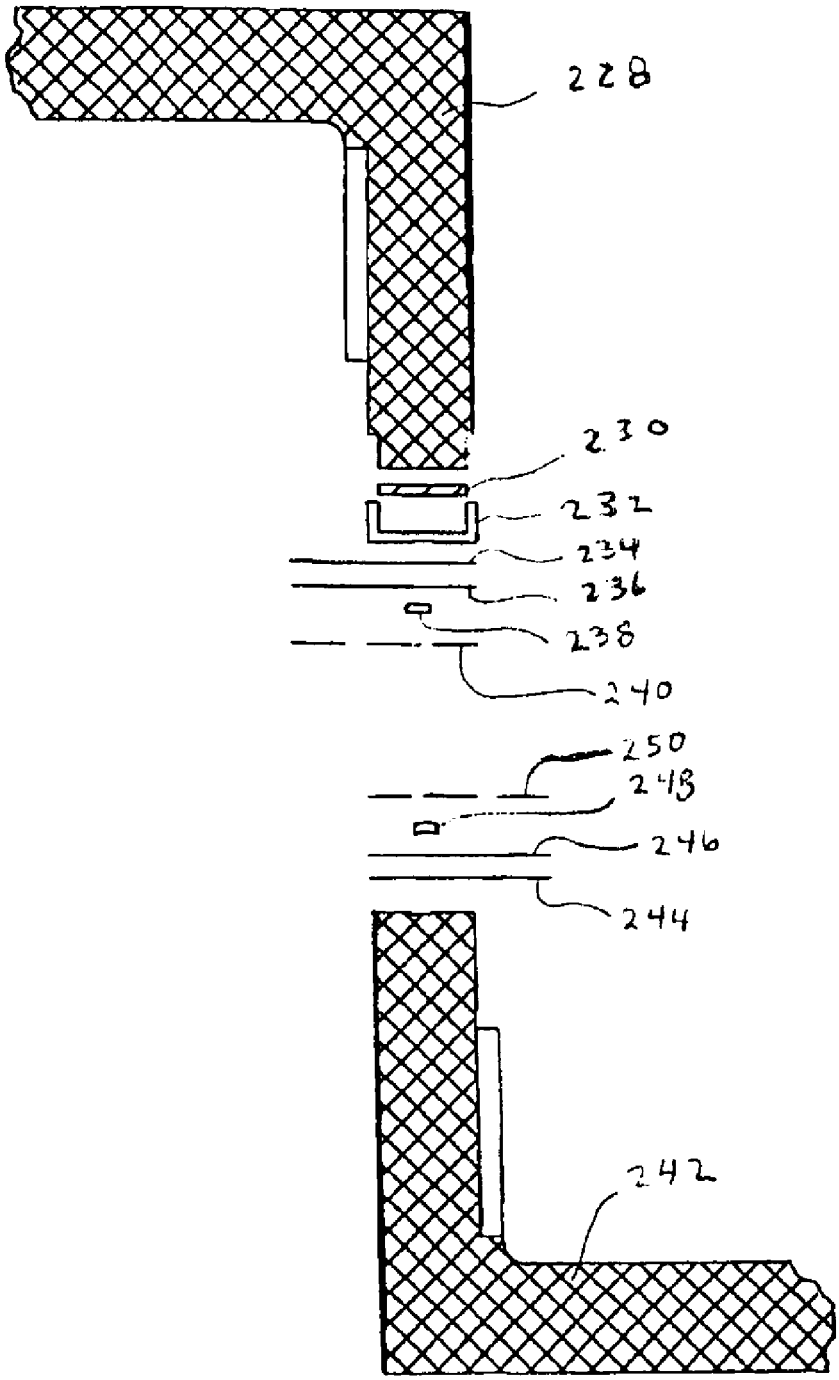
FIG. 8 illustrates a schematic exploded view of a sealing means useful in carrying out the process of the present invention.

FIG. 8 illustrates an exploded schematic view of a preferred sealing apparatus for converting the patch-tubing laminate 226 of FIG. 7 into a patch bag according to the present invention. The sealing apparatus comprises an upper jaw 228, a black neoprene rubber strip 230 having cross-sectional dimensions of 0.060 inch by 0.5 inch, stainless steel jaw groove 232, two strips of 5 mil TEFLON® fluorocarbon tape 234 and 236, rectangular (i.e., flat) cross-section tapered sealing bar 238 having dimensions of 2.5 mm by 0.15 mm, and zone-coated 3 mil TEFLON® fluorocarbon tape 240. The sealing apparatus further comprises lower jaw 242, two strips of 5 mil TEFLON® fluorocarbon tape 244 and 246, domed (i.e., crowned) cross-section tapered sealing bar 248 having dimensions of 3 mm by 0.15 mm, and zone-coated 3 mil TEFLON® fluorocarbon tape 250.

Figure 9:
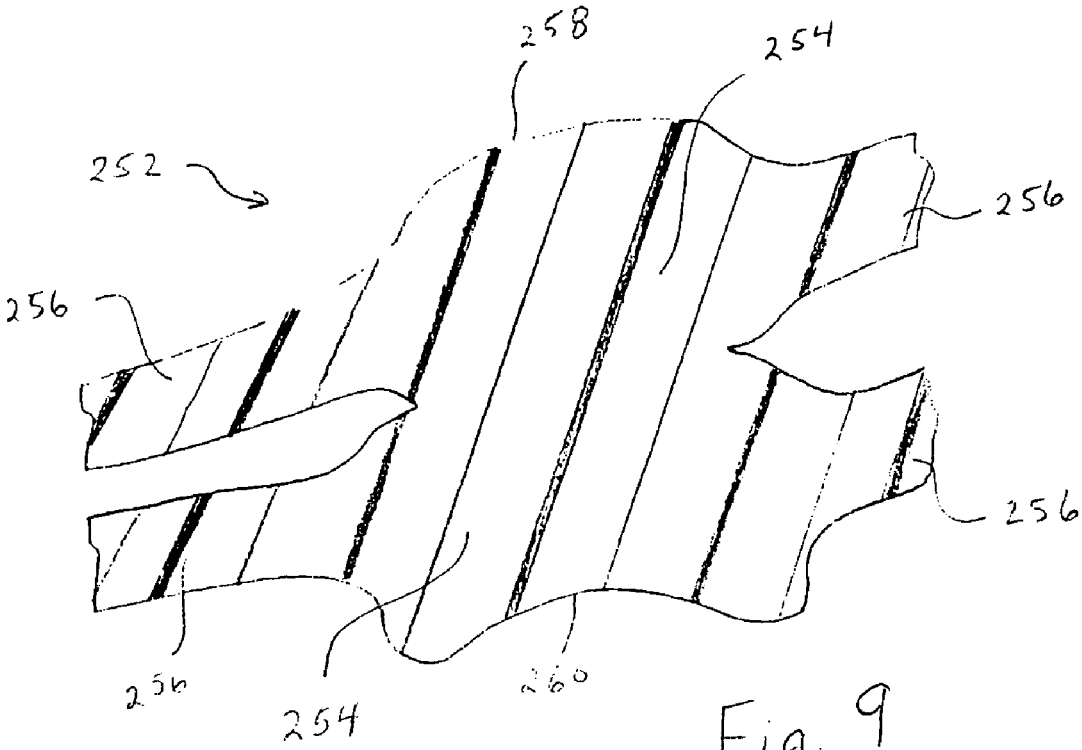
FIG. 9 illustrates an enlarged cross-sectional view of a seal formed using the sealing apparatus as illustrated in FIG. 8.

The sealing apparatus illustrated in FIG. 8, described immediately above, can be used to produce a seal through patches which cover each side of a bag. An enlarged cross-sectional view of such a seal 252 is illustrated in FIG. 9. As can be seen in FIG. 9, the seal region 254 is substantially thicker than various film regions 256 outside of the area affected by the sealing apparatus, because the exposure of the heat-shrinkable bag and patch films to the heat of the sealing apparatus caused each of the films to shrink in the vicinity of the seal, thereby thickening both films at the seal region. It is also apparent that a first surface 258 of the seal presents a convex surface, due to the rectangular cross-sectional shape of seal bar 238 in the apparatus of FIG. 8. However, the other side of the seal presents a concave surface 260 due to the domed (i.e., crowned) cross-sectional shape of seal bar 248 in the apparatus of FIG. 8. Rectangular seal bar 238 provides a flattened surface onto which domed seal bar 248 can readily press and align, without being slipping laterally during sealing. Alternatively, both seal bars could be rectangular (or trapezoidal) in cross-section, which would result in a seal as in FIG. 9 but with both surfaces of the seal being convex, i.e., as first surface 258.

Figure 10:
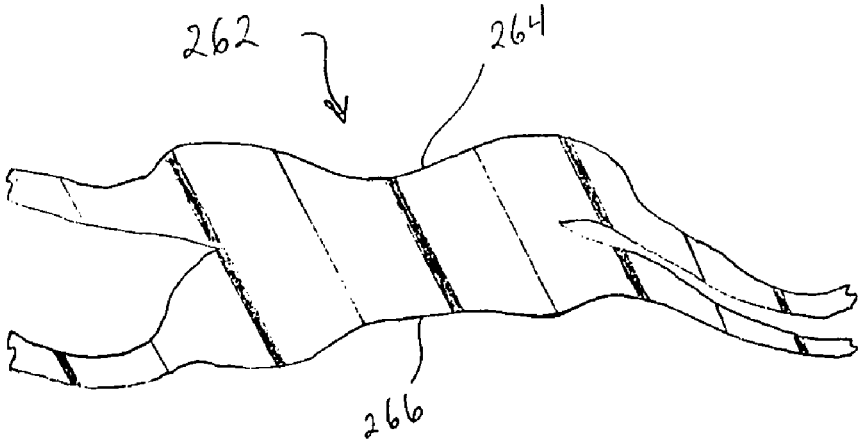
FIG. 10 illustrates an enlarged cross-sectional view of a comparative seal formed using a comparative sealing apparatus (not illustrated) which employed two sealing bars having round cross-sectional shapes.

As a comparative, seal 262, illustrated in FIG. 10, is a less-preferred seal for use in the article of the present invention. Seal 262 was formed using only one sealing bar, this bar being round or domed. The result is a seal having surfaces 264 and 266, each of which are somewhat concave in overall shape.

Figure 11:
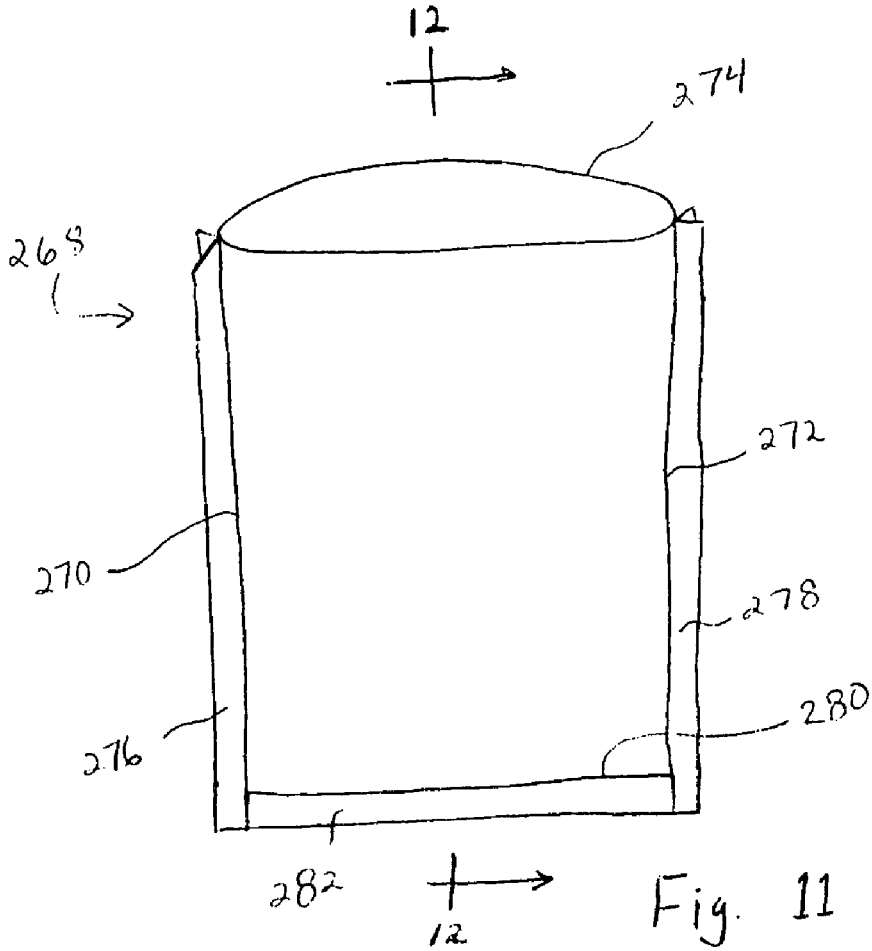
FIG. 11 illustrates a schematic of a preferred side-seal patch bag according to the present invention, in lay-flat view.
Figure 12:
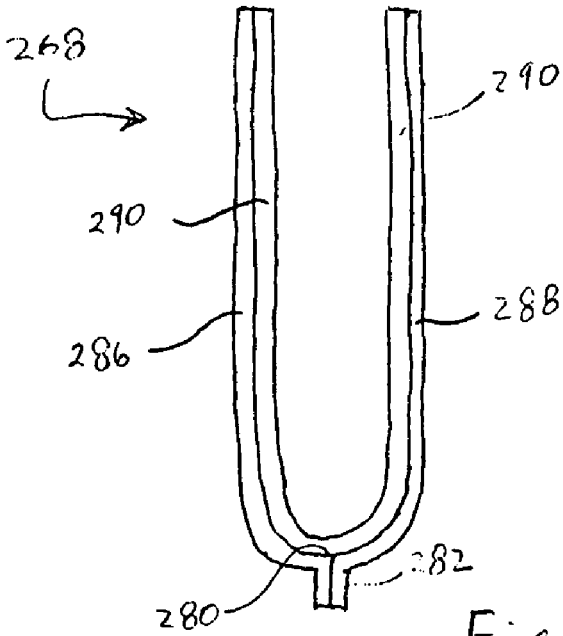
FIG. 12 illustrates a cross-sectional view of the side-seal patch bag according to FIG. 11A, taken through section 12-12 of FIG. 11.

As can be readily recognized by those of skill in the art, a side-seal bag and corresponding process, analogous to the end-seal bag and process therefor described immediately above, can also be made in accordance with the present invention. Such a side-seal bag is illustrated in FIGS. 11 and 12. FIG. 11 illustrates a schematic view of side-seal patch bag 268, in lay-flat position; FIG. 12. Side-seal patch bag 268 has: bag film 290 and patch film 286 and 288 (see FIG. 12); side seals 270 and 272, at which bag film 290 is sealed to itself; open top formed by top edge 274; outward-of-seal edge regions 276 and 278, each of which comprises both bag film 290 and patch films 286 and 288; bag bottom edge 280, which is a fold; and outward-of-fold bottom region 282, in which patch films 286 and 288 are adhered to one another.

It should be noted that patch films 286 and 288 cover the entirety of the outer surface of bag film 290, in order to eliminate the need seal through only bag film 290 without also sealing through patch films 286 and 288. If a portion of the length of bag film 290 did not have a patch film adhered thereover, the formation of side seals 270 and 272 would be problematic because the amount of heat required to seal though both patch film 286 and patch film 288 is significantly greater than the amount of heat needed to seal bag film 290 to itself. As a result, if enough heat is applied to form a strong seal through the patches and the bag film, the uncovered portion of the bag film would likely experience burn through. Also, the bag film just outward of an edge of the patch may well not receive adequate pressure for the formation of a seal, resulting in a leak. On the other hand, if enough heat is applied to form a substantially strong seal of the bag film to itself it is likely that this amount of heat is not likely to result in a substantially strong seal of the bag film to itself where the bag film is covered by a patch film. Thus, is it preferred to cover the entirety of the outside surface of the bag film with patch film if a side-seal patch bag is to be made in accordance with the present invention.

In general, sealing and cutting of tubing to produce bags is disclosed in U.S. Pat. No. 3,552,090, U.S. Pat. No. 3,383,746, and U.S. Serial No. 844,883, filed Jul. 25, 1969, to OWEN, each of these two U.S. Patents as well as the U.S. Patent application, hereby being incorporated by reference thereto, in their entireties.

EXAMPLE

An end-seal patch bag was made and was as schematically illustrated in FIGS. 1 and 2. The patch film was as illustrated in FIG. 3, discussed above, and was made in a process as illustrated in FIG. 4. The bag film was as illustrated in FIG. 5, discussed above, and was made in a process as illustrated in FIG. 6. Thereafter, the patch and bag films were converted to a patch bag using a process as illustrated in FIG. 7, described above. Sealing was carried out using a sealing apparatus as illustrated in FIG. 8, described above, with the seal having a cross-sectional appearance as illustrated in FIG. 9, described above. The seal strength was measured via the Standard Linear Ramped Hot Burst Grease Method, with the bag exhibiting a burst strength of about 40 inches of water.

CONCLUSION

All ranges within all of the above-disclosed ranges are expressly included within this specification. Moreover, layers which are adjacent or directly adhered to one another are preferably of differing chemical composition, especially differing polymeric composition. All reference to ASTM tests are to the most recent, currently approved and published version of the ASTM test identified, as of the priority filing date of this application.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. An end-seal patch bag comprising a heat-shrinkable bag comprising a seamless tubular bag film, and a heat-shrinkable patch comprising a patch film, the patch being adhered to the bag, the patch extending across an entire width of a first lay-flat side of the tubular bag film, the patch bag having a seal across the bottom thereof, the seal being continuous across the entire width of the lay-flat bag film, the seal being through the patch as well as through both lay-flat sides of the bag, the seal being the only seal across the bag, the bag having a top which is not covered by the patch.

2. A patch bag comprising a heat-shrinkable bag comprising a tubular bag film, and a heat-shrinkable patch comprising a patch film, the patch being adhered to the bag, the patch bag having a seal which is through both the patch as well as through both lay-flat sides of the bag, the sealed bag having a burst strength of at least 26 inches of water in a Linear Ramp Hot Burst Grease Test.

3. The patch bag according to claim 2, comprising a first patch adhered to a first lay-flat side of the bag, and a second patch adhered to a second lay-flat side of the bag, and the seal is through both patches and the bag film.

4. The patch bag according to claim 3, wherein the patch bag is a side-seal patch bag, and both the first patch and the second patch extend across an entire length of the bag, the patch bag having a first seal along a first edge of the bag and a second seal along a second edge of the bag, and a folded bottom edge, the first and second seals being through the first patch, the second patch, and the bag film.

5. The patch bag according to claim 3, wherein the patch bag is an end-seal patch bag, and both the first patch and the second patch extend across an entire lay-flat width of the bag film in a lay-flat position, the end-seal patch bag having a bottom seal across the bag, the seal being through the first patch, the bag, and the second patch.

6. The end-seal patch bag according to claim 5, wherein the bag has an uncovered top portion.

7. The end-seal patch bag according to claim 5, wherein the patches are adhered to the tubular bag film with an adhesive.

8. The end-seal patch bag according to claim 5, wherein the patches are adhered to an outside surface of the tubular bag film, and the entirety of the patch films are adhered to the tubular bag film.

9. The end-seal patch bag according to claim 5, wherein each of the patches is wider than the lay-flat width of the tubular bag film.

10. The end-seal patch bag according to claim 5, wherein the tubular bag film is seamless.

11. The patch bag according to claim 2, wherein the seal is made through films having a total thickness of from about 5 to 30 mils.

12. The patch bag according to claim 11, wherein the seal is made through films having a total thickness of from about 10 to 20 mils.

13. The patch bag according to claim 2, wherein the seal has a width of from about 0.015 inch to about 0.25 inch.

* * * * *